US010150294B2

(12) United States Patent
Hirai et al.

(10) Patent No.: US 10,150,294 B2
(45) Date of Patent: Dec. 11, 2018

(54) INKJET HEAD AND INKJET PRINTER

(71) Applicant: Seiko Epson Corporation, Tokyo (JP)

(72) Inventors: Eiju Hirai, Suwa (JP); Toshiaki Hamaguchi, Suwa (JP); Yoichi Naganuma, Suwa (JP); Motoki Takabe, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/547,002

(22) PCT Filed: Mar. 22, 2016

(86) PCT No.: PCT/JP2016/001653
§ 371 (c)(1),
(2) Date: Jul. 27, 2017

(87) PCT Pub. No.: WO2016/157832
PCT Pub. Date: Oct. 6, 2016

(65) Prior Publication Data

US 2018/0022095 A1 Jan. 25, 2018

(30) Foreign Application Priority Data

Mar. 27, 2015 (JP) ..... 2015-065837

(51) Int. Cl.
*B41J 2/14* (2006.01)

(52) U.S. Cl.
CPC ..... *B41J 2/14233* (2013.01); *B41J 2/14072* (2013.01); *B41J 2002/14362* (2013.01); *B41J 2002/14491* (2013.01); *B41J 2202/18* (2013.01)

(58) Field of Classification Search
CPC ..... B41J 2/14233; B41J 2/14072; B41J 2002/14362; B41J 2202/18; B41J 2002/14491
See application file for complete search history.

(56) References Cited

U.S. PATENT DOCUMENTS 8,551,275 B2 * 10/2013 Tsumura ..... B41J 2/14209 156/230
2008/0180490 A1 7/2008 Murata
(Continued)

FOREIGN PATENT DOCUMENTS

JP 2002-292871 A 10/2002
JP 2007-074892 A 3/2007
(Continued)

OTHER PUBLICATIONS

International Search Report from PCT/JP2016/001653, dated Jun. 30, 2016, 3 pages.

*Primary Examiner* — Geoffrey S Mruk
(74) *Attorney, Agent, or Firm* — Workman Nydegger

(57) ABSTRACT

An inkjet head includes: a pressure chamber-forming plate in which a plurality of pressure chambers each communicating with a nozzle are formed in a first direction; a vibration plate that defines one surface of each pressure chamber and allows for deformation of a defining region thereof; a piezoelectric element formed by stacking a first electrode layer, a piezoelectric layer, and a second electrode layer in a region corresponding to the pressure chamber in an order from a surface of the vibration plate, which is opposite to the pressure chamber; a circuit board that is arranged at an interval from the vibration plate, with a plurality of bump electrodes interposed therebetween, and outputs a signal for driving the piezoelectric element; and an adhesive agent that bonds the pressure chamber-forming plate and the circuit board, wherein an element end on at least one side of the piezoelectric element is formed outside of the defining region and covered by the adhesive agent in a second direction orthogonal to the first direction.

6 Claims, 9 Drawing Sheets

(56) References Cited

U.S. PATENT DOCUMENTS

| | | | | |
|---|---|---|---|---|
| 2009/0237454 | A1* | 9/2009 | Kanemoto | B41J 2/14233 347/47 |
| 2010/0302302 | A1 | 12/2010 | Kubo | |
| 2014/0092177 | A1 | 4/2014 | Sugahara et al. | |

FOREIGN PATENT DOCUMENTS

| | | | |
|---|---|---|---|
| JP | 2010-069750 | A | 4/2010 |
| JP | 2013-095088 | A | 5/2013 |

* cited by examiner

[Fig. 1]
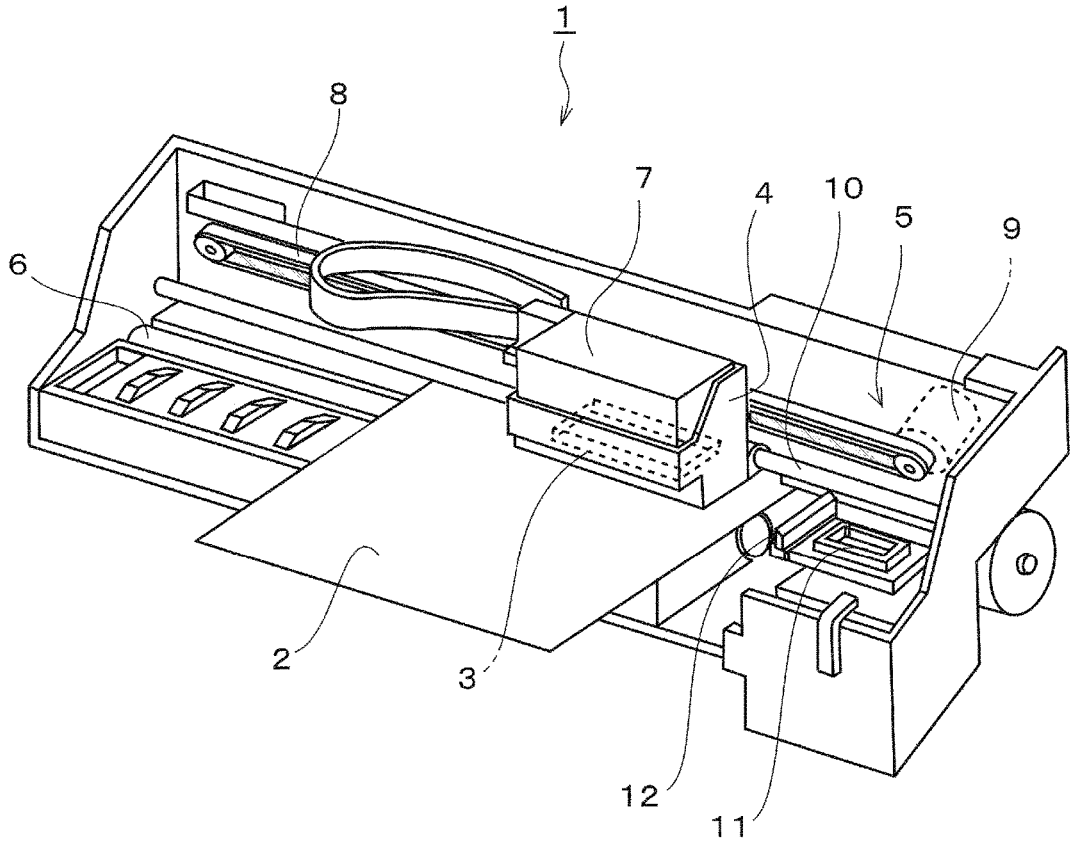

[Fig. 2]
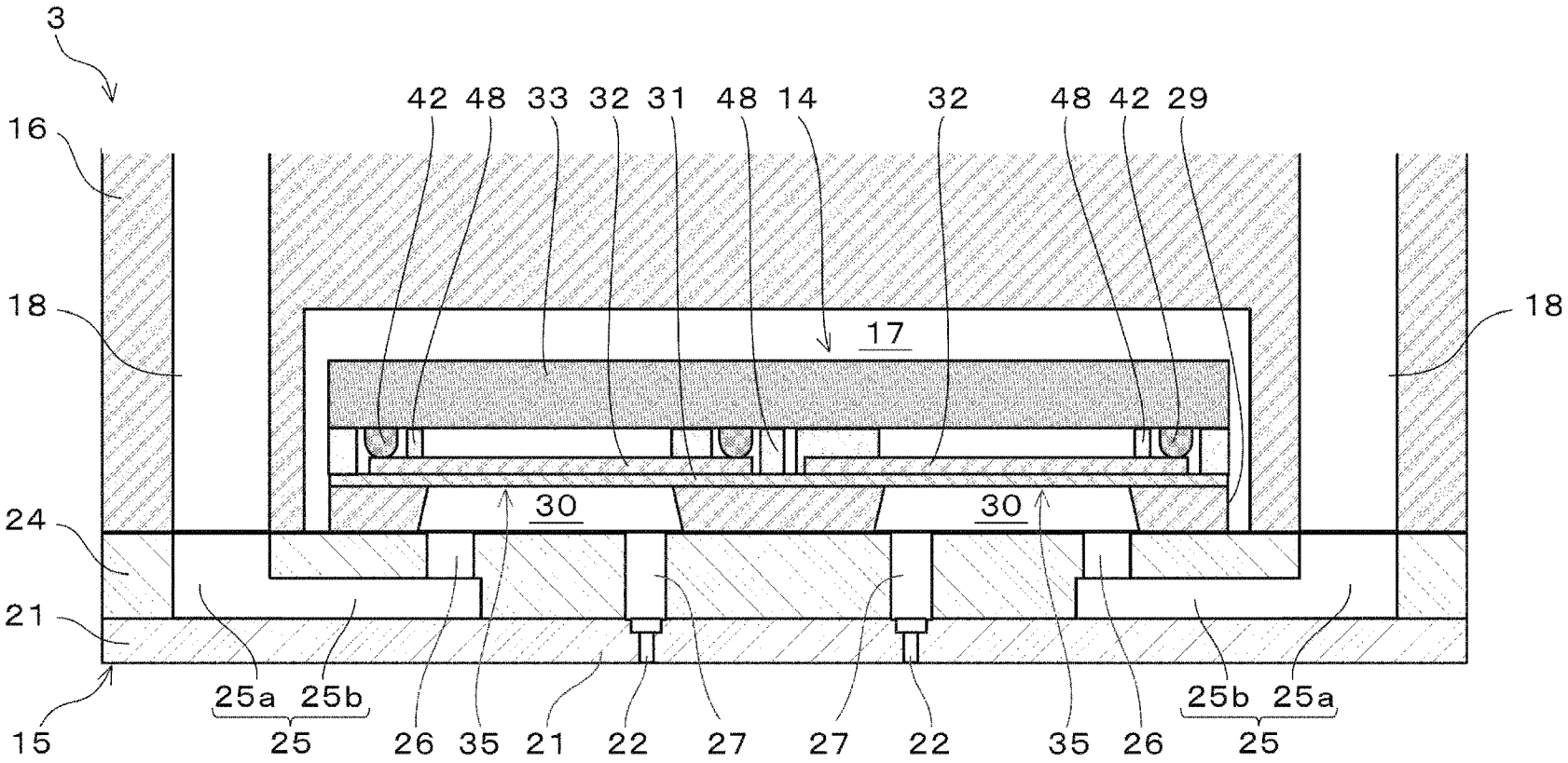

[Fig. 3]
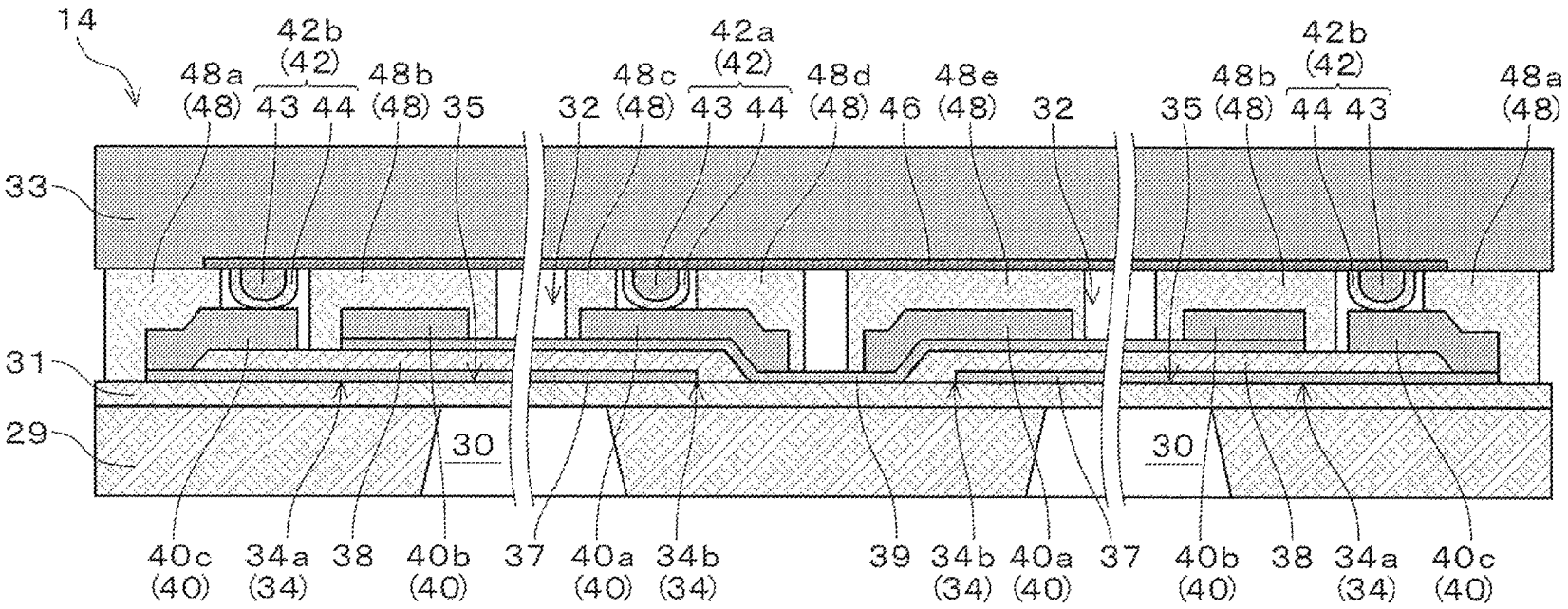

[Fig. 4]
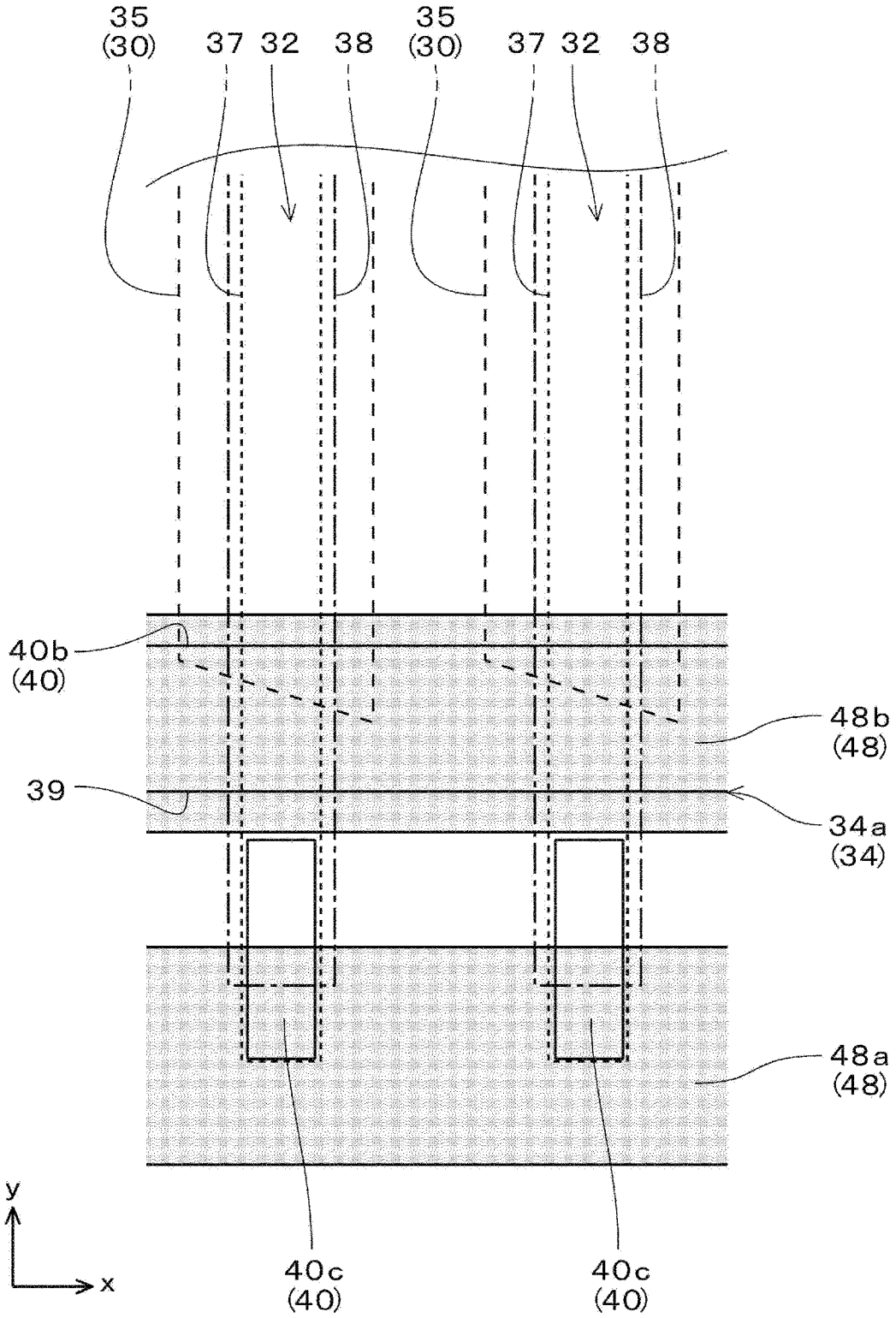

[Fig. 5]
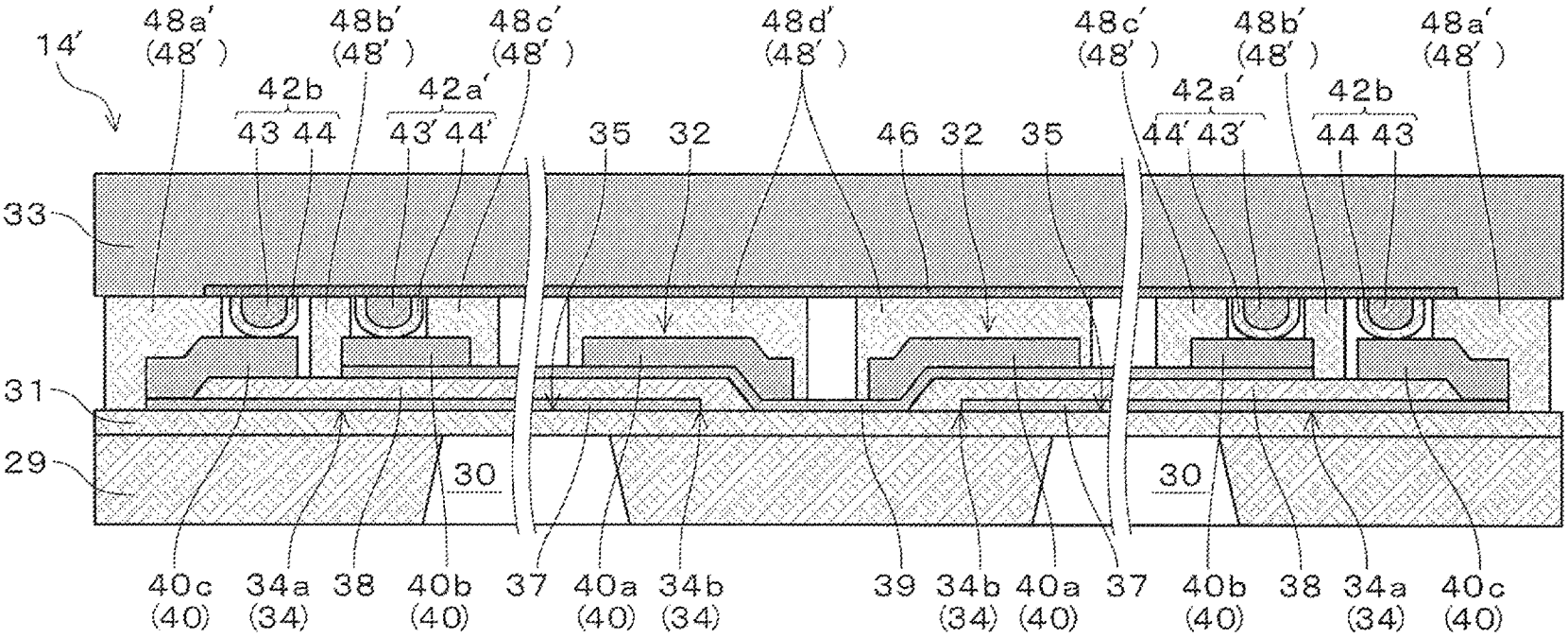

[Fig. 6]
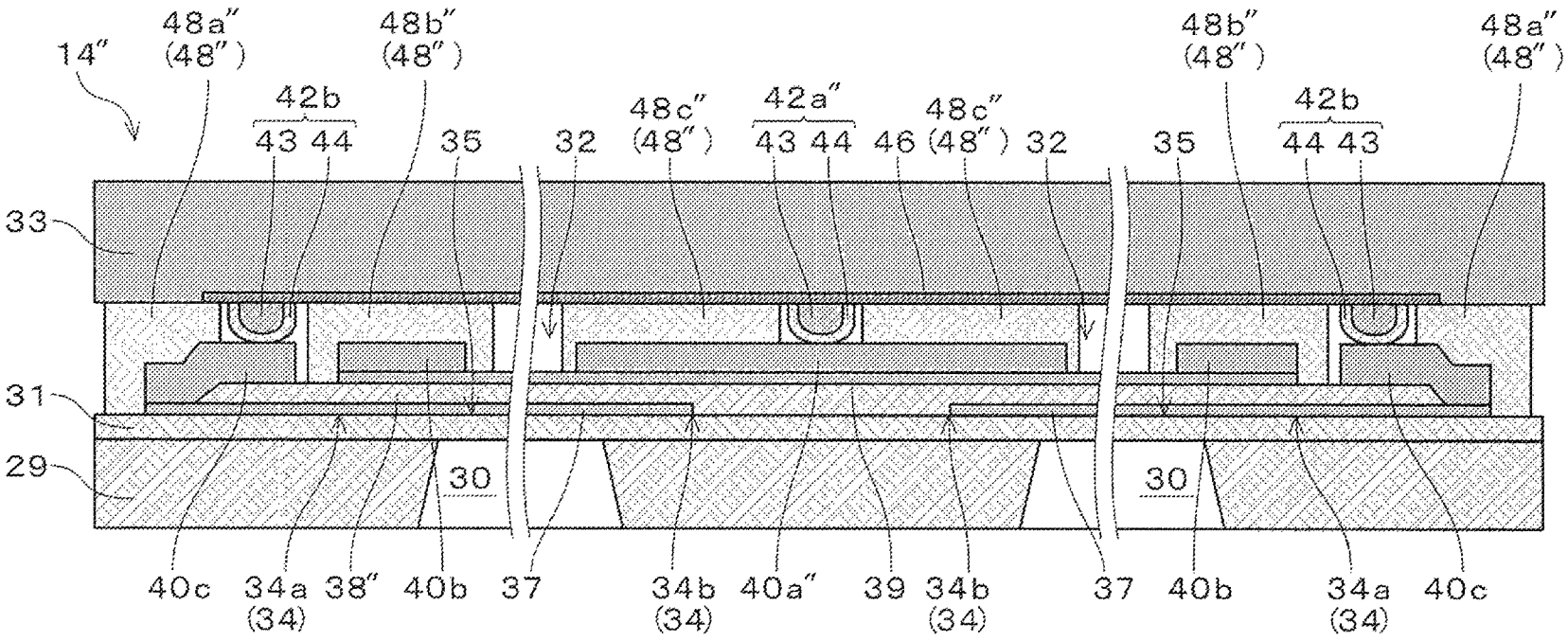

[Fig. 7]
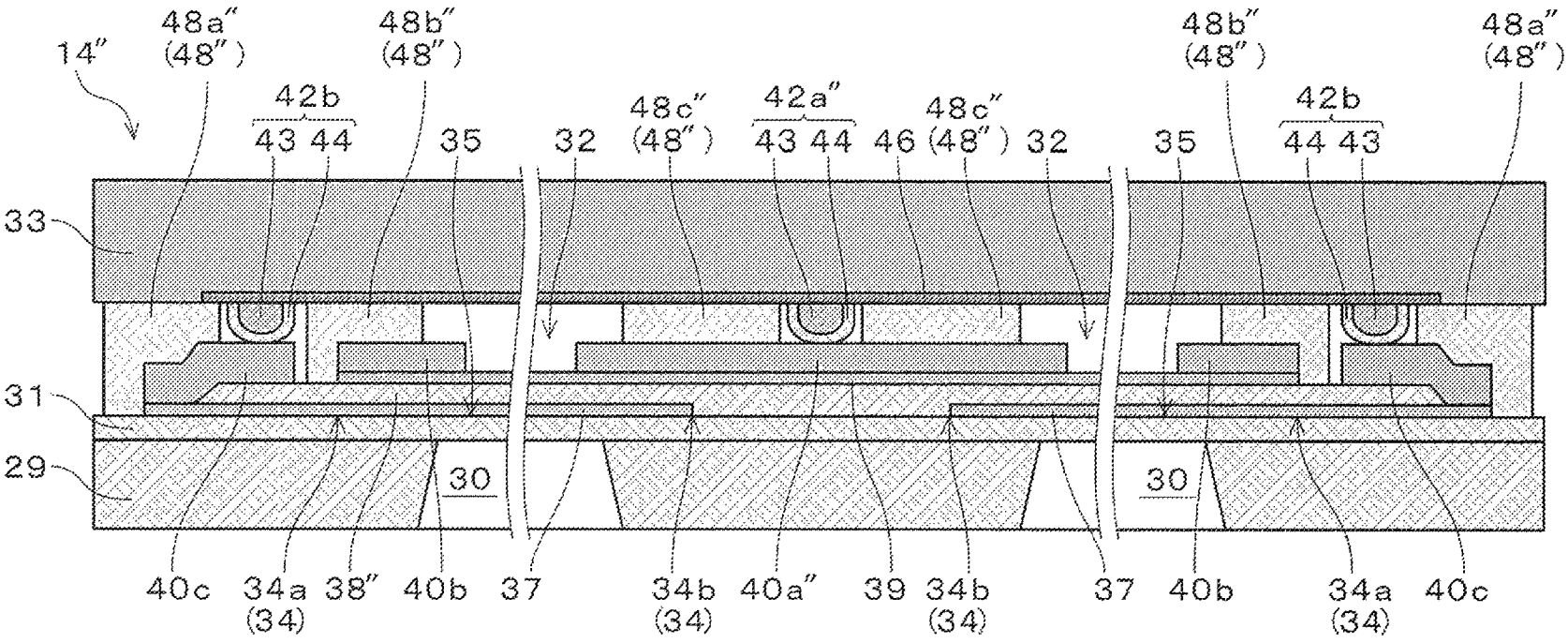

[Fig. 8]
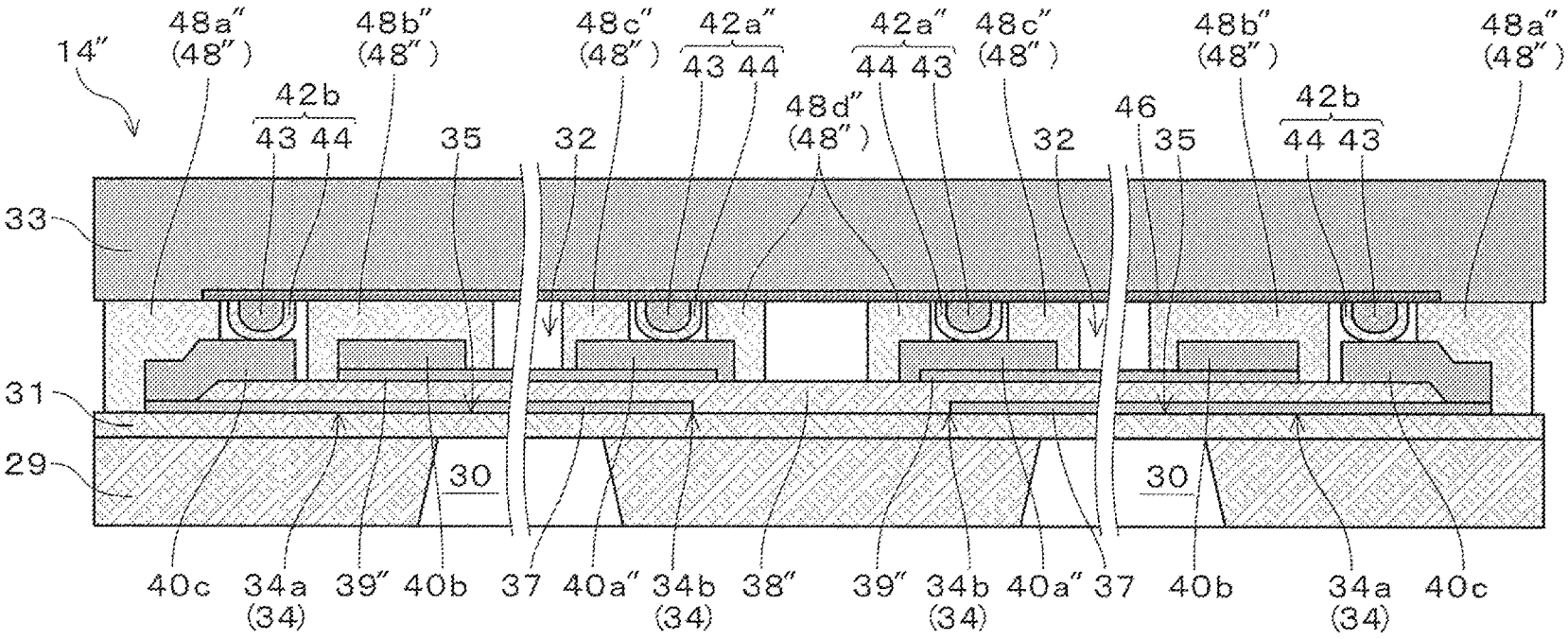

[Fig. 9]
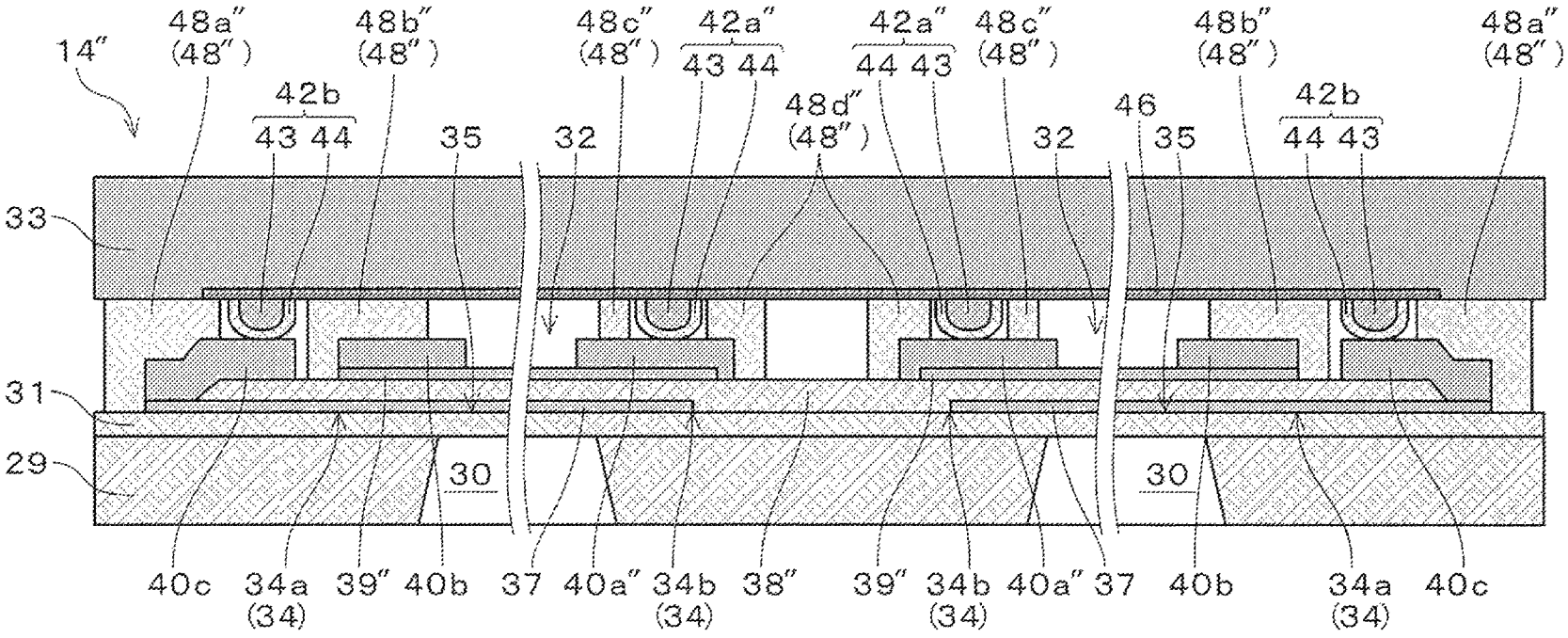

INKJET HEAD AND INKJET PRINTER

TECHNICAL FIELD

The present invention relates to an inkjet head including a piezoelectric element that is deformed by application of voltage, and an inkjet printer including the inkjet head.

BACKGROUND ART

An inkjet printer is a device that includes a permanent head and jets (ejects) various kinds of liquid through this permanent head. The inkjet printer is a non-impact printing device that forms a character on a sheet by jetting particles and droplets of ink (JIS X0012-1990). The inkjet printer is a kind of dot printers that print characters and images expressed with a plurality of dots, and the inkjet printer prints characters and images expressed with a plurality of dots formed by jetting ink particles or droplets. The permanent head (hereinafter, referred to as an "inkjet head") is a mechanical or electrical component of a printer body, which continuously or intermittently generates ink droplets (JIS Z8123-3; 2013). This inkjet printer is not only used as an image recording device, but also applied to various kinds of manufacturing devices by exploiting the capability of accurately landing an extremely small amount of liquid onto a predetermined position. For example, the inkjet printer is applied to a display manufacturing device that manufactures a color filter of a liquid crystal display and the like, an electrode forming device that forms electrodes of an organic electro luminescence (EL) display and a surface emission display (or a field emission display (FED)), and a chip manufacturing device that manufactures a biochip (a biochemical element).

The inkjet head described above is configured to drive the piezoelectric element to cause a pressure variation of liquid in a pressure chamber, thereby jetting liquid from a nozzle using this pressure variation. This piezoelectric element may be formed by stacking: a lower electrode layer serving as a common electrode that is common to a plurality of pressure chambers; a piezoelectric layer of lead zirconate titanate (PZT) or the like; and upper electrode layers serving as individual electrodes provided for the respective pressure chambers, in this order from the pressure chambers side, by a film formation technique (refer to PTL 1, for example). These lower electrode layer and the upper electrode layer are drawn outside of the piezoelectric layer on the substrate and connected with a flexible cable and a drive circuit (also referred to as a driver circuit), for example. When voltage is applied to the lower electrode layer and the upper electrode layer through the flexible cable and the like, the piezoelectric layer between the electrode layers is deformed. Thus, the electrode layers and a part therebetween serve as the piezoelectric element that causes a pressure variation in the pressure chamber.

SUMMARY OF INVENTION

Technical Problem

When the piezoelectric element deforms, stress due to this deformation is generated at a boundary in the piezoelectric layer between a part which is not sandwiched between both electrode layers and another part which is sandwiched between both electrode layers to serve as the piezoelectric element. This stress potentially causes, for example, cracks in the piezoelectric layer.

The invention has been made in view of such circumstances, and an object of the invention is to provide an inkjet head and inkjet printer which can prevent generation of, for example, cracks on the piezoelectric layer.

Solution to Problem

An inkjet head of the invention includes: a pressure chamber-forming plate in which a plurality of pressure chambers each communicating with a nozzle are formed in a first direction; a vibration plate that defines one surface of each pressure chamber and allows for deformation of a defining region thereof; a piezoelectric element formed by stacking a first electrode layer, a piezoelectric layer, and a second electrode layer in a region corresponding to the pressure chamber in an order from a surface of the vibration plate, which is opposite to the pressure chamber; a circuit board that is arranged at an interval from the vibration plate, with a plurality of bump electrodes interposed therebetween, and outputs a signal for driving the piezoelectric element; and an adhesive agent that bonds the pressure chamber-forming plate and the circuit board, wherein an element end on at least one side of the piezoelectric element is formed outside of the defining region and covered by the adhesive agent in a second direction orthogonal to the first direction.

According to this configuration, since the element end of the piezoelectric element is formed outside of the defining region, deformation at this element end is prevented. Since the element end is covered by the adhesive agent, deformation due to the element end is further prevented. This can prevent generation of stress due to deformation of the piezoelectric element at a boundary between this element end and the piezoelectric layer at a position off the element end (that is, a boundary between the piezoelectric layer included in the piezoelectric element and the piezoelectric layer formed outside of the piezoelectric element). This can prevent generation of, for example, cracks on the piezoelectric layer at the boundary.

It is preferable that the adhesive agent is formed to extend from the element end to a position overlapping an end of the defining region in the second direction, which is closer to the element end in the above configuration.

According to this configuration, deformation of the piezoelectric element at an end of the defining region can be prevented. This can reduce generation of stress due to deformation of the piezoelectric element at a boundary between the defining region and a region outside of the defining region. This can prevent generation of, for example, cracks on the piezoelectric layer at the boundary.

It is preferable that the bump electrode includes elastic resin, and a conductive film covering a surface of the resin in the above configurations.

According to this configuration, pressure applied between the pressure chamber-forming plate and the circuit board to reliably conduct the bump electrodes and each electrode layer bonding the pressure chamber-forming plate and the circuit board can be reduced. This can prevent damage on the pressure chamber-forming plate or the circuit board.

It is preferable that the bump electrode is electrically connected with at least one of the first electrode layer and the second electrode layer on the piezoelectric layer formed in a region outside of the defining region in the above configurations.

According to this configuration, an interval between the piezoelectric element and the circuit board can be more reliably maintained. This can reduce prevention of deformation of the piezoelectric element.

It is preferable that the adhesive agent is photosensitive in the above configurations.

According to this configuration, the adhesive agent can be accurately disposed at a predetermined position by performing exposure and development after the adhesive agent is applied. This can prevent the adhesive agent from being applied off the position, thereby downsizing the inkjet head.

An inkjet printer of the invention includes the inkjet head according to the above configuration.

BRIEF DESCRIPTION OF DRAWINGS

FIG. 1 is a perspective diagram of the configuration of a printer.

FIG. 2 is a cross-sectional view of the configuration of a recording head.

FIG. 3 is a cross-sectional view of the configuration of an actuator unit.

FIG. 4 is a plan view of the configuration of the actuator unit.

FIG. 5 is a cross-sectional view of the configuration of an actuator unit according to a second embodiment of the invention.

FIG. 6 is a cross-sectional view of the configuration of an actuator unit according to a third embodiment of the invention.

FIG. 7 is a cross-sectional view of the configuration of an actuator unit according to a fourth embodiment of the invention.

FIG. 8 is a cross-sectional view of the configuration of an actuator unit according to a fifth embodiment of the invention.

FIG. 9 is a cross-sectional view of the configuration of an actuator unit according to a sixth embodiment of the invention.

DESCRIPTION OF EMBODIMENTS

Exemplary embodiments of the invention will be described below with reference to the accompanied drawings. While various limitations are made as preferred examples of the invention in the embodiments below, the scope of the invention is not limited to these embodiments unless the invention is explicitly limited in the following description. The following description will be made of a printer 1 on which a recording head 3 as a kind of inkjet head is mounted, as an inkjet printer according to the invention.

Description will be made of the configuration of the printer 1 with reference to FIG. 1. The printer 1 is a device that jets ink (a kind of liquid) onto a surface of a recording medium 2 (a kind of landing target) such as recording paper to record, for example, an image. The printer 1 includes the recording head 3, a carriage 4 to which the recording head 3 is attached, a carriage moving mechanism 5 that moves the carriage 4 in a main scanning direction, and a conveyance mechanism 6 that conveys the recording medium 2 in a sub scanning direction. The ink is stored in an ink cartridge 7 as a liquid supply source. The ink cartridge 7 is detachably mounted on the recording head 3. Alternatively, the ink cartridge may be provided on a body of the printer to supply ink to the recording head through an ink supply tube.

The carriage moving mechanism 5 includes a timing belt 8. The timing belt 8 is driven by a pulse motor 9 such as a DC motor. Thus, when the pulse motor 9 operates, the carriage 4 reciprocates in the main scanning direction (width direction of the recording medium 2) while being guided by a guide rod 10 provided across the printer 1. The position of the carriage 4 in the main scanning direction is detected by a linear encoder (not illustrated) as a kind of position information detection unit. The linear encoder transmits its detection signal, which is an encoder pulse (a kind of position information) to a controller of the printer 1.

A home position as a base point of scanning of the carriage 4 is set at an end region outside a recording region in a movement range of the carriage 4. Arranged at this home position in the following order from an end are a cap 11 that seals a nozzle 22 formed on a nozzle surface (nozzle plate 21) of the recording head 3, and a wiping unit 12 that wipes the nozzle surface.

Next follows a description of the recording head 3. FIG. 2 is a cross-sectional view of the configuration of the recording head 3. FIG. 3 is an enlarged cross-sectional view of a main part of the recording head 3, in other words, is a cross-sectional view of an actuator unit 14. FIG. 4 is an enlarged plan view of a main part (end part on the left side in FIG. 3) of the actuator unit 14. The recording head 3 in the present embodiment is attached to a head case 16 while the actuator unit 14 and a passage unit 15 are stacked as illustrated in FIG. 2. In order to clearly illustrate a positional relation of a piezoelectric element 32, a pressure chamber 30, and an adhesive agent 48, for example, other components are omitted in FIG. 4. In the following description, a vertical direction is defined as a direction in which components included in the actuator unit 14 are stacked.

The head case 16 is a box made of synthetic resin including a reservoir 18 that supplies ink to each pressure chamber 30. The reservoir 18 is a space that stores ink to be supplied in common to the pressure chambers 30. Two reservoirs 18 are formed for two lines of the pressure chambers 30 arranged in parallel (as lined up). An ink introducing path (not illustrated) for introducing ink from the ink cartridge 7 to the each reservoir 18 is formed above the head case 16. A housing space 17 as a rectangular parallelepiped recess is formed closer to a bottom surface of the head case 16, extending from the bottom surface up to halfway in a height direction of the head case 16. The passage unit 15 to be described later is positioned and bonded with a positioning on the bottom surface of the head case 16, and thereby the actuator unit 14 (including a pressure chamber-forming plate 29 and a sealing plate 33, for example) stacked on a communicating plate 24 is to be housed in the housing space 17.

The passage unit 15 bonded on the bottom surface of the head case 16 includes the communicating plate 24 and the nozzle plate 21. The communicating plate 24 is a silicon plate, and is made of a single crystal silicon substrate having (110) planes at its surfaces (top surface and bottom surface) in the present embodiment. As illustrated in FIG. 2, the communicating plate 24 includes a common liquid chamber 25 and an individual communicating path 26, which are formed by etching. The common liquid chamber 25 communicates with the reservoir 18 and stores ink to be supplied in common to the pressure chambers 30. The individual communicating path 26 supplies ink from the reservoir 18 individually to the pressure chambers 30 through the common liquid chamber 25. The common liquid chamber 25 is an elongated hollow portion along a direction (first direction x; refer to FIG. 4) in which the pressure chambers 30 are arranged in parallel. Two common liquid chambers 25 are formed for the two reservoirs 18. The common liquid chambers 25 each include a first liquid chamber 25*a* penetrating in a plate-thickness direction of the communicating plate 24, and a second liquid chamber 25*b* formed as a recess up to halfway in the plate-thickness direction of the communicating plate 24 from the bottom surface thereof toward the top surface thereof, leaving a thin plate portion closer to the top surface. A plurality of the individual communicating paths 26 are arranged in the direction in which the pressure chambers 30 are arranged in parallel, and are each formed for the corresponding pressure chamber 30 in the thin plate portion of the second liquid chamber 25*b*. The communicating plate 24 and the pressure chamber-forming plate 29 are positioned and bonded so that the individual communicating paths 26 each communicate with an end of the corresponding pressure chamber 30 in a longitudinal direction thereof.

The communicating plate 24 includes a nozzle communicating path 27 that penetrates at a position corresponding to each nozzle 22 in the plate-thickness direction of the communicating plate 24. In other words, a plurality of the nozzle communicating paths 27 are formed in a nozzle-array direction in which nozzle arrays extend, at positions corresponding to the nozzle arrays. The pressure chambers 30 and the nozzles 22 communicate through the nozzle communicating paths 27. The communicating plate 24 and the pressure chamber-forming plate 29 are positioned and bonded so that the nozzle communicating path 27 according to the present embodiment communicates with the other end (opposite to the individual communicating path 26) of the corresponding pressure chamber 30 in the longitudinal direction (second direction y orthogonal to the first direction x; refer to FIG. 4) thereof.

The nozzle plate 21 is a silicon substrate (for example, a single crystal silicon substrate) bonded on the bottom surface (opposite to the pressure chamber-forming plate 29) of the communicating plate 24. In the present embodiment, the nozzle plate 21 seals an opening of a space as the common liquid chamber 25, which is closer to the bottom surface. The nozzle plate 21 is provided with a straight line (column) of the nozzles 22 as openings. In the present embodiment, the nozzle arrays are formed in two lines corresponding to two lines of the pressure chambers 30. The nozzles 22 (nozzle arrays) arranged in parallel are provided at an equal pitch (for example, 600 dpi) corresponding to a dot formation density from the nozzle 22 at an end of an array to the nozzle 22 at the other end in the sub scanning direction orthogonal to the main scanning direction. The nozzle plate may be bonded in a region on the communicating plate, which is other than the region just under the common liquid chamber, and the opening of the space as the common liquid chamber, which is closer to the bottom surface, may be sealed by a flexible compliance sheet, for example. In this manner, the nozzle plate can be minimized as much as possible.

The actuator unit 14 is formed into a unit by stacking the pressure chamber-forming plate 29, a vibration plate 31, the piezoelectric element 32, and the sealing plate 33, as illustrated in FIGS. 2 and 3. The actuator unit 14 is formed to be smaller than the housing space 17 so as to be housed in the housing space 17.

The pressure chamber-forming plate 29 is a hard silicon plate, and is made of a single crystal silicon substrate having (110) planes at its surfaces (top surface and bottom surface) in the present embodiment. Part of the pressure chamber-forming plate 29 is completely removed by etching in the plate-thickness direction to form a plurality of space extending in the first direction x to serve as the pressure chambers 30. Each space has its bottom defined by the communicating plate 24 and its top defined by the vibration plate 31, serving as the pressure chamber 30. These space, in other words, the pressure chambers 30 are formed in two lines corresponding to the two lines of nozzle arrays. Each pressure chamber 30 is a hollow portion elongated in the second direction y (in other words, the longitudinal direction of the pressure chamber 30) orthogonal to the first direction x (in other words, the nozzle-array direction). One end of the pressure chamber 30 in the second direction y communicates with the individual communicating path 26, and the other end thereof communicates with the nozzle communicating path 27. Both sidewalls of the pressure chamber 30 according to the present embodiment in the second direction y are tilted relative to the top surface or bottom surface of the pressure chamber-forming plate 29 due to the crystalline property of the single crystal silicon substrate.

The vibration plate 31 is an elastic thin film stacked on the top surface (opposite to the communicating plate 24) of the pressure chamber-forming plate 29. The vibration plate 31 seals a top opening of the space that is to serve as the pressure chamber 30. In other words, the vibration plate 31 defines the top surface of the pressure chamber 30. A defining region 35 of the vibration plate 31, which defines the top surface of the pressure chamber 30, serves as a displacement portion that is deformed (displaces) in a direction of becoming further apart from or closer to the nozzle 22 due to deflection of the piezoelectric element 32. In other words, deflection is allowed in the defining region 35 of the vibration plate 31 and prevented outside the defining region 35 of the vibration plate 31. The vibration plate 31 includes, for example, an elastic film of silicon dioxide ($SiO_2$) formed on the top surface of the pressure chamber-forming plate 29, and an insulation film of zirconium dioxide ($ZrO_2$) formed on this elasticity film. Each piezoelectric element 32 is stacked at a position on this insulation film (surface of the vibration plate 31, which is opposite to the pressure chamber 30) corresponding to the defining region 35.

The piezoelectric element 32 according to the present embodiment is a piezoelectric element that operates in what is called a deflection mode. The piezoelectric elements 32 arranged in parallel in two lines corresponding to two lines of the pressure chambers 30 arranged in parallel. As illustrated in FIG. 3, each piezoelectric element 32 is formed, on the vibration plate 31, by sequentially stacking a lower electrode layer 37 (corresponding to a first electrode layer in the invention), a piezoelectric layer 38, an upper electrode layer 39 (corresponding to a second electrode layer in the invention), and a metallic layer 40, in this order. In the present embodiment, the lower electrode layer 37 is an individual electrode that is formed independently for each piezoelectric element 32, whereas the upper electrode layer 39 is a common electrode that is formed continuously across the plurality of piezoelectric elements 32. In other words, as illustrated in FIG. 4, the lower electrode layer 37 and the piezoelectric layer 38 are formed for each pressure chamber 30. In contrast, the upper electrode layer 39 is formed across the pressure chambers 30.

Specifically, as illustrated in FIG. 4, each piezoelectric layer 38 in the present embodiment has a width smaller than a width (dimension in the first direction x) of the defining region 35 (pressure chamber 30) and extends in the second direction y. The piezoelectric layers 38 are arranged in parallel in two lines corresponding to two lines of the pressure chambers 30 arranged in parallel. As illustrated in FIG. 3, each end in the second direction y of each piezoelectric layer 38 extends from a position overlapping the corresponding pressure chamber 30 to a position not overlapping the pressure chamber 30. In other words, an end of the piezoelectric layer 38 on one side (outside of the actuator unit 14) in the second direction y is positioned outside of an end of the corresponding defining region 35 on the same side. An end of the piezoelectric layer 38 on the other side (inside of the actuator unit 14) in the second direction y is positioned outside of an end of the corresponding defining region 35 on the same side.

Similarly to the piezoelectric layer 38, each lower electrode layer 37 in the present embodiment has a width smaller than the width of the defining region 35 and extends in the second direction y. The lower electrode layers 37 are arranged in parallel in two lines corresponding to two lines of the pressure chambers 30 arranged in parallel. As illustrated in FIGS. 3 and 4, one end (on the outside of the actuator unit 14) of each lower electrode layer 37 in the second direction y is positioned outside of the corresponding end of the piezoelectric layer 38. An individual metallic layer 40*c* to be described later is stacked on this end of the lower electrode layer 37. As illustrated in FIG. 3, the other end (on the inside of the actuator unit 14) of the lower electrode layer 37 in the second direction y is a part overlapped by the piezoelectric layer 38 and is positioned outside of the corresponding end of the defining region 35. In other words, the other end of the lower electrode layer 37 in the second direction y is positioned in a region between the corresponding end of the defining region 35 and the corresponding end of the piezoelectric layer 38.

Both ends of the upper electrode layer 39 in the present embodiment in the first direction x are positioned outside of a region overlapping a set of the pressure chambers 30 arranged in parallel. In other words, the upper electrode layer 39 is formed across the piezoelectric layers 38 arranged in parallel in the first direction x. As illustrated in FIG. 3, the upper electrode layer 39 is formed across the piezoelectric layers 38 on both sides in the second direction y. Specifically, one end (on the left side in FIG. 3) of the upper electrode layer 39 in the second direction y overlaps one (left in FIG. 3) of the piezoelectric layers 38 arranged in parallel in two lines and is positioned outside of a region overlapping the corresponding one of the defining regions 35. In other words, one end of the upper electrode layer 39 in the second direction y is positioned in a region between the outer end of the corresponding one of the defining regions 35 and the outer end of the corresponding one of the piezoelectric layers 38. The other end (on the right side in FIG. 3) of the upper electrode layer 39 in the second direction y overlaps the other (right in FIG. 3) of the piezoelectric layers 38 arranged in parallel in two lines and is positioned outside of a region overlapping the other of the defining regions 35. In other words, the other end of the upper electrode layer 39 in the second direction y is positioned in a region between the outer end of the other of the defining regions 35 and the outer end of the other of the piezoelectric layers 38.

A region in which the lower electrode layer 37, the piezoelectric layer 38, and the upper electrode layer 39 are all stacked, in other words, a region in which the piezoelectric layer 38 is sandwiched between the lower electrode layer 37 and the upper electrode layer 39, serves as the piezoelectric element 32. Specifically, when an electric field is applied between the lower electrode layer 37 and the upper electrode layer 39 in accordance with a potential difference between both electrodes, the piezoelectric layer 38 is deflected in the direction of becoming further away from or closer to the nozzle 22, which is deformed the defining region 35 of the vibration plate 31. As described above, in a region extending from a position overlapping the defining region 35 to a position not overlapping the defining region 35 on one side (outside of the actuator unit 14) in the second direction y, the piezoelectric layer 38 extends beyond the upper electrode layer 39, and the lower electrode layer 37 extends further beyond the piezoelectric layer 38, so that the position of an end of the upper electrode layer 39 coincides with the position of an element end 34*a* on one side of the piezoelectric element 32. In contrast, in a region extending from a position overlapping the defining region 35 to a position not overlapping the defining region 35 on the other end (on the inside of the actuator unit 14) in the second direction y, the piezoelectric layer 38 extends beyond the lower electrode layer 37, and the upper electrode layer 39 extends further beyond the piezoelectric layer 38, so that the position of the other end of the lower electrode layer 37 coincides with the position of an element end 34*b* on the other side of the piezoelectric element 32. In other words, the element ends 34 on both sides of the piezoelectric element 32 in the present embodiment are formed outside of the defining region 35 in the second direction y. Part of the piezoelectric element 32, which extends beyond the defining region 35, is prevented from deforming (displacing) by the pressure chamber-forming plate 29.

The metallic layers 40 are provided on both sides of the piezoelectric element 32 in the present embodiment in the longitudinal direction (second direction y). The metallic layer 40 formed on the other end of the piezoelectric element 32 is a first common metallic layer 40*a* as a common electrode stacked on the upper electrode layer 39. The first common metallic layer 40*a* extends from a region overlapping the other end of the defining region 35 to a region overlapping the piezoelectric layer 38 in the second direction y. Similarly to the upper electrode layer 39, both ends of the first common metallic layer 40*a* in the first direction x are positioned outside of the region overlapping the set of the pressure chambers 30 arranged in parallel. The first common metallic layer 40*a* prevents deformation of the element end 34*b* on the other side of the piezoelectric element 32. This can prevent generation of stress due to deformation of the piezoelectric element 32, and can prevent generation of, for example, cracks on the piezoelectric layer 38. A common bump electrode 42*a* to be described later is connected on the first common metallic layer 40*a* corresponding to one of the piezoelectric elements 32.

Similarly to the first common metallic layer 40*a*, the metallic layer 40 formed on one side of the piezoelectric element 32 is a second common metallic layer 40*b* as a common electrode stacked on the upper electrode layer 39. The second common metallic layer 40*b* extends from a region overlapping one end of the defining region 35 to the corresponding end of the upper electrode layer 39 (that is, the element end 34*a*) in the second direction y. Similarly to the first common metallic layer 40*a*, both ends of the second common metallic layer 40*b* in the first direction x are positioned outside of the region overlapping the set of the pressure chambers 30 arranged in parallel. The second common metallic layer 40*b* prevents deformation of the element end 34*a* on one side of the piezoelectric element 32 and the one end of the defining region 35.

The individual metallic layer 40*c* as an individual electrode whose part is stacked on the lower electrode layer 37 is formed outside of the one end of the piezoelectric element 32 in the second direction y. As illustrated in FIG. 4, similarly to the lower electrode layer 37, the individual metallic layer 40*c* is formed smaller than the width of the defining region 35, and a plurality of the individual metallic layers 40*c* are formed in the first direction x. The individual metallic layer 40*c* in the present embodiment extends from a region outside of one end of the upper electrode layer 39 in the second direction y and overlapping one end of the piezoelectric layer 38 to a region overlapping one end of the lower electrode layer 37, beyond the region which overlaps one end of the piezoelectric layer 38. An individual bump electrode 42*b* to be described later is connected on the individual metallic layer 40*c*.

The lower electrode layer 37 and the upper electrode layer 39 described above are made of various kinds of metals such as iridium (Ir), platinum (Pt), titanium (Ti), tungsten (W), nickel (Ni), palladium (Pd), and gold (Au), alloys thereof, and an alloy such as $LaNiO_3$. The piezoelectric layer 38 is made of a ferroelectric piezoelectric material such as lead zirconate titanate (PZT), and relaxor ferroelectric as combination of this ferroelectric piezoelectric material and metal such as niobium (Nb), nickel (Ni), magnesium (Mg), bismuth (Bi), or yttrium (Y). Alternatively, the piezoelectric layer 38 may be made of a non-lead material such as barium titanate. The metallic layer 40 is an adhered layer made of titanium (Ti), nickel (Ni), chromium (Cr), tungsten (W), or alloys thereof, on which gold (Au) and copper (Cu), for example, are stacked.

The sealing plate 33 (corresponding to a circuit board in the invention) is a plate arranged at an interval from the vibration plate 31 (or the piezoelectric element 32). This interval is set not to prevent deformation of the piezoelectric element 32. The sealing plate 33 according to the present embodiment is made of a single crystal silicon substrate having (110) planes at its surfaces (top surface and bottom surface), and has a dimension that is substantially the same as the outside diameter of the pressure chamber-forming plate 29 in a plan view. As illustrated in FIG. 3, a drive circuit 46 (driver circuit) that outputs a signal (drive signal) for individually driving the piezoelectric element 32 is formed in a region of the sealing plate 33, which is opposite to the piezoelectric element 32. The drive circuit 46 is produced by providing semiconductor processing (that is, deposition, photolithography, and etching, for example) on a surface of the single crystal silicon substrate (silicon wafer) as the sealing plate 33.

An elastic bump electrode 42 protruding toward the pressure chamber-forming plate 29 is formed in a region of the sealing plate 33, which is outside of the defining region 35 and opposite to the first common metallic layer 40*a* and the individual metallic layer 40*c* formed on the piezoelectric layer 38. The bump electrode 42 includes an elastic inside resin 43, and a conductive film 44 electrically connected with corresponding wiring in the drive circuit 46 and covering a surface of the inside resin 43. In the present embodiment, the individual bump electrodes 42*b* connected with the individual metallic layers 40*c* of the respective piezoelectric elements 32 formed in two lines are formed in two lines. The common bump electrode 42*a* connected with the first common metallic layer 40*a* common to the piezoelectric elements 32 formed in two lines is formed in one line between the individual bump electrodes 42*b* formed in two lines. The inside resin 43 is made of, for example, resin such as polyimide resin. The conductive film 44 is made of metal such as gold (Au), copper (Cu), nickel (Ni), titanium (Ti), or tungsten (W).

More specifically, the inner resin 43 of the individual bump electrode 42*b* is formed as a protrusion in the first direction x in a region on a surface of the sealing plate 33, which is opposite to the individual metallic layer 40*c*. A plurality of the conductive films 44 of the individual bump electrodes 42*b* are formed in the first direction x, corresponding to the piezoelectric elements 32 arranged in parallel in the first direction x. That is, a plurality of the individual bump electrodes 42*b* are formed in the first direction x. Each individual bump electrode 42*b* is connected with the corresponding individual metallic layer 40*c* on the piezoelectric layer 38. In this manner, the individual bump electrode 42*b* is electrically connected with the lower electrode layer 37 through the individual metallic layer 40*c*.

The inner resin 43 of the common bump electrode 42*a* is formed as a protrusion in the first direction x in a region on the surface of the sealing plate 33, which is opposite to the first common metallic layer 40*a*. The inner resin 43 of the common bump electrode 42*a* in the present embodiment is formed in one line at a position corresponding to one (left in FIG. 3) of the piezoelectric elements 32 formed in two lines. A plurality of the conductive films 44 of the common bump electrodes 42*a* are formed in the first direction x, corresponding to the piezoelectric elements 32 arranged in parallel in the first direction x. That is, a plurality of the common bump electrodes 42*a* are formed in the first direction x. Each common bump electrode 42*a* is connected with the first common metallic layer 40*a* at a plurality of positions on the piezoelectric layer 38 in the first direction x. In this manner, the common bump electrode 42*a* is electrically connected with the upper electrode layer 39 through the first common metallic layer 40*a*.

The sealing plate 33, and the pressure chamber-forming plate 29 on which the vibration plate 31 and the piezoelectric element 32 are stacked, are bonded by the adhesive agent 48 with the bump electrodes 42 therebetween. The adhesive agent 48 is disposed in strips extending in the first direction x on both sides of each bump electrode 42 and at a position covering the first common metallic layer 40*a* on the other side with which the bump electrode 42 is not connected. Specifically, an adhesive agent 48*a* disposed outside of the individual bump electrode 42*b* (opposite to the common bump electrode 42*a*) extends from a top of the individual metallic layer 40*c* to a top of the vibration plate 31 beyond an end of the individual metallic layer 40*c* in the second direction y. An adhesive agent 48*b* disposed inside of the individual bump electrode 42*b* (closer to the common bump electrode 42*a*) extends from outside of the second common metallic layer 40*b* (piezoelectric element 32) to a position overlapping one end of the defining region 35 in the second direction y. In other words, the adhesive agent 48*b* is formed to extend from a position covering the element end 34*a* on one side of the piezoelectric element 32 in the second direction y to a position overlapping the end of the defining region 35 closer to the element end 34*a*. That is, the adhesive agent 48*b* covers the element end 34*a* on one side of the piezoelectric element 32 in the second direction y. This prevents deformation of the piezoelectric element 32 at the element end 34*a*. The adhesive agent 48*b* also covers one end of the defining region 35. This prevents deformation of the piezoelectric element 32 at one end of the defining region 35.

An adhesive agent 48*c* disposed outside of the common bump electrode 42*a* (closer to one of the individual metallic layers 40*c*) extends from a position overlapping the other end of the defining region 35 to an end of the first common metallic layer 40*a* in the second direction y. The adhesive agent 48*c* covers the other end of the defining region 35 corresponding to one of the piezoelectric elements 32, thereby preventing deformation of the piezoelectric element 32 at this end. An adhesive agent 48*d* disposed inside of the common bump electrode 42*a* (closer to the other of the individual metallic layers 40*c*) extends from a top of the first common metallic layer 40*a* to a top of the vibration plate 31 beyond an end of the first common metallic layer 40*a* in the second direction y. An adhesive agent 48*e* is disposed at the element end 34*b* on the other side (inside) of the first common metallic layer 40*a* with which the common bump electrode 42*a* is not in contact and that is closer to the other of the piezoelectric elements 32. The adhesive agent 48*e* extends from a position overlapping the other end of the defining region 35 corresponding to the other of the piezoelectric elements 32 to a top of the vibration plate 31 beyond the first common metallic layer 40*a* in the second direction y. The adhesive agent 48*e* also covers the other end of the defining region 35 corresponding to the other of the piezoelectric elements 32. This prevents deformation of the piezoelectric element 32 at the other end of the defining region 35.

The adhesive agent 48 is preferably, for example, a photosensitive and thermosetting resin. For example, the adhesive agent 48 is desirably resin including a primary component of epoxy resin, acrylic resin, phenolic resin, polyimide resin, silicone resin, or styrene resin.

The recording head 3 formed as described above introduces ink from the ink cartridge 7 to the pressure chambers 30 through the ink introducing path, the reservoir 18, the common liquid chamber 25, and the individual communicating path 26. When ink is introduced in the pressure chambers 30, a signal supplied from the drive circuit 46 to each piezoelectric element 32 through the bump electrodes 42 drives the piezoelectric elements 32, causing a pressure variation within the pressure chambers 30. The recording head 3 exploits this pressure variation to jet an ink droplet from the nozzles 22 through the nozzle communicating paths 27.

As described above, in the recording head 3 in the present embodiment, since the element ends 34 on both sides of the piezoelectric element 32 are each formed outside of the defining region 35, deformation at the element end 34 is prevented. Since the element end 34*a* on one side of the piezoelectric element 32 in the second direction y is covered by the adhesive agent 48, deformation at this element end 34*a* is further prevented. This can prevent generation of stress due to deformation of the piezoelectric element 32 at a boundary between the element end 34 and the piezoelectric layer 38 at a position off the element end 34 (that is, a boundary between the piezoelectric layer 38 included in the piezoelectric element 32 and the piezoelectric layer 38 formed outside of the piezoelectric element 32). This can prevent generation of, for example, cracks on the piezoelectric layer 38 at the boundary. In the present embodiment, since the adhesive agent 48 is formed to extend from the element end 34*a* on one side of the piezoelectric element 32 in the second direction y to a position overlapping the end of the defining region 35, which is closer to the element end 34*a*, deformation of the piezoelectric element 32 at the end of the defining region 35 can be prevented. This can reduce generation of stress due to deformation of the piezoelectric element 32 at a boundary between the defining region 35 and a region outside of the defining region 35. This can prevent generation of, for example, cracks on the piezoelectric layer 38 at the boundary. In this manner, generation of cracks on the piezoelectric layer 38 can be prevented to achieve an improved reliability of the piezoelectric element 32, and thus an improved reliability of the recording head 3.

Since the bump electrode 42 includes the elastic inner resin 43, and the conductive film 44 covering the surface of the inner resin 43, this configuration can reduce pressure applied between the pressure chamber-forming plate 29 and the sealing plate 33, which is to reliably conduct the bump electrode 42 and each electrode layer, when bonding the pressure chamber-forming plate 29 and the sealing plate 33. This can prevent damage on the pressure chamber-forming plate 29 or the sealing plate 33. Since the bump electrode 42 is electrically connected with the lower electrode layer 37 and the upper electrode layer 39 on the piezoelectric layer 38 formed in a region outside of the defining region 35, an interval between the piezoelectric element 32 and the sealing plate 33 can be more reliably maintained. That is, since the bump electrode 42 is arranged at a position where a dimension (height) from the surface of the vibration plate 31 is relatively large (high), an interval between the piezoelectric element 32 and the sealing plate 33 can be more reliably maintained. In particular, in the present embodiment, since the bump electrode 42 is arranged on the metallic layer 40, the interval between the piezoelectric element 32 and the sealing plate 33 can be more reliably maintained. This can reduce prevention of deformation of the piezoelectric element 32 by the sealing plate 33. Since the adhesive agent 48 is photosensitive, the adhesive agent 48 can be accurately disposed at a predetermined position by performing exposure and development after the adhesive agent 48 is applied. This can prevent the adhesive agent 48 from being applied off the position, thereby downsizing the recording head 3. Specifically, being applied off the predetermined position, the adhesive agent 48 can avoid interference with other components included in the actuator unit 14, and can be disposed as close to the components as possible. Consequently, the actuator unit 14 can be downsized, and thus the recording head 3 can be downsized.

Next follows a description of a method of manufacturing the recording head 3, in particular, the actuator unit 14 described above. The actuator unit 14 according to the present embodiment is obtained by bonding, with the adhesive agent 48, a single crystal silicon substrate (silicon wafer) on which a plurality of regions to be the sealing plates 33 are formed, and a single crystal silicon substrate (silicon wafer) on which a plurality of regions to be the pressure chamber-forming plate 29 on which the vibration plate 31 and the piezoelectric element 32 are stacked are formed, and by cutting the bonded substrates into pieces.

Specifically, the drive circuit 46, for example, is first formed on the bottom surface (opposite to the pressure chamber-forming plate 29) of the single crystal silicon substrate, which is closer to the sealing plate 33, through semiconductor processing. Next, a resin film is produced on the bottom surface of the single crystal silicon substrate, and after being formed by photolithography and etching, the inner resin 43 is melted by heating to round its corners. Then, a metal film is formed on a surface of the inner resin 43 by such as evaporation coating and sputtering, and the conductive film 44 is formed by photolithography and etching. Accordingly, a plurality of regions to be each the sealing plate 33 corresponding to the individual recording head 3 are formed on the single crystal silicon substrate.

The vibration plate 31 is stacked on the top surface (opposite to the sealing plate 33) of the single crystal silicon substrate, which is closer to the pressure chamber-forming plate 29. Next, semiconductor processing sequentially provides patterning on such as the lower electrode layer 37, the piezoelectric layer 38, and the upper electrode layer 39, so as to form the piezoelectric element 32, for example. Accordingly, a plurality of regions to be each the pressure chamber-forming plate 29 corresponding to the individual recording head 3 are formed on the single crystal silicon substrate. After this, an adhesive agent layer is formed on the surface, and the adhesive agent 48 is formed at a predetermined position by photolithography. Specifically, a photosensitive and thermosetting liquid adhesive agent is applied on the vibration plate 31 by using, for example, a spin coater, and heated to form an elastic adhesive agent layer. Then, the shape of the adhesive agent 48 is patterned at the predetermined position through exposure and development. In the present embodiment, since the adhesive agent 48 is photosensitive, the adhesive agent 48 can be accurately patterned by photolithography.

When the adhesive agent 48 is formed, both single crystal silicon substrates are bonded. Specifically, one of the single crystal silicon substrates is relatively moved toward the other single crystal silicon substrate, and the adhesive agent 48 is provided between both single crystal silicon substrates to bond the substrates together. Then, both single crystal silicon substrates are pressurized from above and below against an elastic restoring force by the bump electrodes 42. This crushes the bump electrodes 42 to achieve reliable conduction. Then, while being pressurized, the substrates are heated to a curing temperature of the adhesive agent 48. Consequently, the adhesive agent 48 is cured while the bump electrodes 42 are crushed, and both single crystal silicon substrate are bonded.

Once both single crystal silicon substrates are bonded, the single crystal silicon substrate including the pressure chamber-forming plate 29 is polished from the bottom surface (opposite to the single crystal silicon substrate including the sealing plate 33) to be thin. After this, the pressure chambers 30 are formed on the thinned single crystal silicon substrate including the pressure chamber-forming plate 29 by photolithography and etching. Finally, the bonded single crystal silicon substrates are scribed along a predetermined scribing line and then cut into individual actuator units 14.

Then, the actuator unit 14 manufactured by the process described above is positioned and fixed on the passage unit 15 (communicating plate 24) by using, for example, adhesive agent. Thereafter, while the actuator unit 14 is housed in the housing space 17 of the head case 16, the head case 16 and the passage unit 15 are bonded together, thereby manufacturing the recording head 3 described above.

In the first embodiment described above, the common bump electrode 42*a* is connected with one of the first common metallic layers 40*a* formed in two lines, but the invention is not limited thereto. For example, in an actuator unit 14' in a second embodiment illustrated in FIG. 5, common bump electrodes 42*a*' are connected with the respective second common metallic layers 40*b* formed in two lines.

Specifically, inner resins 43' of the common bump electrodes 42*a*' are formed as protrusions in the nozzle-array direction (first direction x) in a region on the surface of the sealing plate 33, which is opposite to the second common metallic layer 40*b*. A plurality of conductive films 44' of the common bump electrodes 42*a*' are formed in the first direction x, corresponding to the piezoelectric elements 32 arranged in parallel in the first direction x. That is, a plurality of the common bump electrodes 42*a*' are formed in the first direction x. The common bump electrodes 42*a*' are connected at a plurality of positions in the first direction x with the second common metallic layers 40*b* formed in two lines on the piezoelectric layer 38. In this manner, each common bump electrode 42*a*' is electrically connected with the upper electrode layer 39 through the second common metallic layer 40*b*.

Adhesive agent 48' in the present embodiment is disposed on both sides of each of the bump electrodes 42*a*' and 42*b* and at a position covering the first common metallic layer 40*a*. Specifically, the adhesive agent 48*a*' disposed outside (opposite to the common bump electrode 42*a*') of the individual bump electrode 42*b* extends from a top of the individual metallic layer 40*c* to a top of the vibration plate 31 beyond an end of the individual metallic layer 40*c* in the second direction y. Adhesive agent 48*b*' disposed between the individual bump electrode 42*b* and the common bump electrode 42*a*' extends from a top of the piezoelectric layer 38 outside of the second common metallic layer 40*b* (the piezoelectric element 32) to a top of the second common metallic layer 40*b* beyond the element end 34*a* on one side of the piezoelectric element 32 in the second direction y. The adhesive agent 48*b*' covers the element end 34*a* on one side of the piezoelectric element 32 in the second direction y. This prevents deformation of the piezoelectric element 32 at the element end 34*a*. Adhesive agent 48*c*' disposed inside (opposite to the individual bump electrode 42*b*) of the common bump electrode 42*a*' extends from a top of the second common metallic layer 40*b* to a position overlapping one side of the defining region 35 beyond an end of the second common metallic layer 40*b* in the second direction y. The adhesive agent 48*c*' covers one end of the defining region 35. This prevents deformation of the piezoelectric element 32 at one end of the defining region 35. Adhesive agent 48*d*' covering the first common metallic layer 40*a* extends from a position overlapping the other side of the defining region 35 to a top of the vibration plate 31 beyond the first common metallic layer 40*a* in the second direction y. The adhesive agent 48*d*' covers the other end of the defining region 35. This prevents deformation of the piezoelectric element 32 at the other end of the defining region 35. Other components have the same configuration as that of the first embodiment described above, and thus descriptions thereof will be omitted.

In the embodiments described above, the piezoelectric layers 38 are formed in two lines corresponding to two lines of the pressure chambers 30, that is, the piezoelectric layer 38 are individually formed for the respective pressure chambers 30, but the invention is not limited thereto. For example, in an actuator unit 14" according to third to sixth embodiments illustrated in FIGS. 6 to 9, a piezoelectric layer 38" common to the pressure chambers 30 formed in two lines is formed in one line. In particular, in the actuator unit 14" in the third and fourth embodiments illustrated in FIGS. 6 and 7, the piezoelectric layer 38" and a first common metallic layer 40*a*" are each formed in one line.

Specifically, in the third embodiment illustrated in FIG. 6, the piezoelectric layer 38" is formed across the piezoelectric elements 32 on both sides in the second direction y. Specifically, one end (left side in FIG. 6) of the piezoelectric layer 38" in the second direction y extends to a region overlapping one (left in FIG. 6) of the individual metallic layers 40*c* arranged in parallel in two lines. The other end (on the right side in FIG. 6) of the piezoelectric layer 38" in the second direction y extends to a region overlapping the other (right in FIG. 6) of the individual metallic layers 40*c* arranged in parallel in two lines. The first common metallic layer 40*a*" extends from a region overlapping the other end (on the inside of the actuator unit 14") of one (left in FIG. 6) of the defining regions 35 (pressure chambers 30) to a region overlapping the other end (on the inside of the actuator unit 14") of the other (right side in FIG. 6) of the defining regions 35 (pressure chambers 30) in the second direction y. The common bump electrode 42*a*" is formed in a region between the pressure chambers 30 formed in two lines, and connected with the first common metallic layer 40*a*".

The adhesive agent 48" in the present embodiment is disposed on both sides of the bump electrodes 42*a*" and 42*b*. Adhesive agent 48*a*" disposed outside (opposite to the common bump electrode 42*a*") of the individual bump electrode 42*b* is disposed across from a top of the individual metallic layer 40*c* to a top of the vibration plate 31, similarly to the adhesive agent 48*a* in the first embodiment. Adhesive agent 48*b*" disposed inside of the individual bump electrode 42*b* (closer to the common bump electrode 42*a*") extends from outside of the second common metallic layer 40*b* to a position overlapping one end of the defining region 35, similarly to the adhesive agent 48*b* in the first embodiment. Adhesive agent 48*c*" disposed both sides of the common bump electrode 42*a*" extends from a position overlapping the other end of the defining region 35 to a top of the first common metallic layer 40*a*" beyond a position overlapping the lower electrode layer 37 in the second direction y. Other components have the same configuration as that of the first embodiment described above, and thus descriptions thereof will be omitted.

In the fourth embodiment illustrated in FIG. 7, each adhesive agent 48" is disposed not in a region overlapping the pressure chamber 30. In other words, the adhesive agent 48" is disposed at a position not overlapping the defining region 35. Specifically, adhesive agent 48*b*" disposed inside of the individual bump electrode 42*b* (closer to the common bump electrode 42*a*") extends from a region between the individual metallic layer 40*c* and the second common metallic layer 40*b* to a top of the second common metallic layer 40*b* in a region outside of the defining region 35 in the second direction y. Adhesive agent 48*c*" disposed on both sides of the common bump electrode 42*a*" is formed in a region over the element end 34*b* on the other side of the piezoelectric element 32, on the first common metallic layer 40*a*" in a region outside of the defining region 35. Other components have the same configuration as that of the third embodiment described above, and thus descriptions thereof will be omitted.

Since the adhesive agent 48" is formed in a region outside of the defining region 35 as described above, deformation of the vibration plate 31 in the defining region 35 is hardly prevented. This allows for efficient conveyance of a pressure variation due to the drive of the piezoelectric element 32 to ink in the pressure chambers 30, and also can prevent degradation of adhesivity due to vibration of the piezoelectric element 32 conveyed to the adhesive agent 48". Consequently, the recording head 3 can have an improved reliability. In addition, since the adhesive agent 48" and the defining region 35 do not overlap each other, variation in the amount of deformation of the vibration plate 31 due to variation in the position of the adhesive agent 48" can be prevented. Thus, even when adhesive agent having no photosensitivity, that is, adhesive agent likely to have variation in bonding position is used as the adhesive agent 48", variation in ink jetting characteristic can be prevented.

In the fifth embodiment illustrated in FIG. 8, the common bump electrodes 42*a*" connected with the respective first common metallic layers 40*a*" formed in two lines are formed in two lines. Specifically, similarly to the first embodiment, the first common metallic layers 40*a*" extends from a region overlapping the other side of the defining region 35 to outside of a region overlapping the lower electrode layer 37 in the second direction y. The lines of the common bump electrodes 42*a*" are formed in the first direction x. The common bump electrodes 42*a*" are connected at a plurality of positions in the first direction x with the first common metallic layers 40*a*" on the piezoelectric layer 38". Similarly to the third embodiment described above, the piezoelectric layer 38" is formed across the piezoelectric elements 32 on both sides in the second direction y. That is, one end of the piezoelectric layer 38" (on the left side in FIG. 8) in the second direction y extends to a region overlapping one (left in FIG. 8) of the individual metallic layers 40*c* arranged in parallel in two lines. The other end of the piezoelectric layer 38" (on the right side in FIG. 8) in the second direction y extends to a region overlapping the other (right in FIG. 8) of the individual metallic layers 40*c* arranged in parallel in two lines.

The upper electrode layers 39" in the present embodiment are formed in two lines corresponding to two lines of the pressure chambers 30. That is, the upper electrode layers 39" are individually formed for the respective pressure chambers 30. Specifically, the upper electrode layers 39" each formed across the piezoelectric layers 38" arranged in parallel in the first direction x are formed in two lines. One end (on the outside of the actuator unit 14") of each upper electrode layer 39" in the second direction y is positioned outside of a region overlapping the one side of the corresponding defining region 35, and in a region between the defining region 35 and the individual metallic layer 40*c*. The other end (on the inside of the actuator unit 14") of the upper electrode layer 39" in the second direction y is positioned outside of a region overlapping the other side of the defining region 35, and in a region between the other end of the lower electrode layer 37 and the other end of the first common metallic layer 40*a*".

The adhesive agent 48" in the present embodiment is disposed on both sides of each of the bump electrodes 42*a*" and 42*b*. Specifically, adhesive agent 48*a*" disposed outside of the individual bump electrode 42*b* (opposite to the common bump electrode 42*a*") is disposed across from a top of the individual metallic layer 40*c* and a top of the vibration plate 31, similarly to the adhesive agent 48*a* in the first embodiment. Adhesive agent 48*b*" disposed inside of the individual bump electrode 42*b* (closer to the common bump electrode 42*a*") extends from outside of the second common metallic layer 40*b* to a position overlapping one end of the defining region 35, similarly to the adhesive agent 48*b* in the first embodiment. Adhesive agent 48*c*" disposed outside of the common bump electrode 42*a*" (closer to the individual bump electrode 42*b*) extends from a position overlapping the other end of the defining region 35 to an end of the first common metallic layer 40*a*" in the second direction y. Adhesive agent 48*d*" disposed inside of the common bump electrode 42*a*" extends from a top of the first common metallic layer 40*a*" to a top of the piezoelectric layers 38" beyond the end of the first common metallic layer 40*a*" in the second direction y. Other components have the same configuration as that of the first embodiment described above, and thus descriptions thereof will be omitted.

In the sixth embodiment illustrated in FIG. 9, similarly to the fifth embodiment described above, the common bump electrodes 42*a*" connected with the respective first common metallic layers 40*a*" formed in two lines are formed in two lines. The sixth embodiment is, however, different from the fifth embodiment in that the adhesive agent 48" is disposed not in a region overlapping the pressure chamber 30 (defining region 35). Specifically, adhesive agent 48*b*" disposed inside of the individual bump electrode 42*b* (closer to the common bump electrode 42*a*") extends from a region between the individual metallic layer 40*c* and the second common metallic layer 40*b* to a top of the second common metallic layer 40*b* in a region outside of the defining region 35 in the second direction y. Adhesive agent 48*c*" disposed outside of the common bump electrode 42*a*" (closer to the individual bump electrode 42*b*) is formed on the first common metallic layer 40*a*" in a region outside of the defining region 35. Other components have the same configuration as that of the sixth embodiment described above, and thus descriptions thereof will be omitted.

In the present embodiment, since the adhesive agent 48" is formed in a region outside of the defining region 35 as described above, deformation of the vibration plate 31 in the defining region 35 is hardly prevented. This allows for efficient conveyance of a pressure variation due to the drive of the piezoelectric element 32 to ink in the pressure chamber 30, and also can prevent degradation of adhesivity due to vibration of the piezoelectric element 32 conveyed to the adhesive agent 48". Consequently, the recording head 3 can have an improved reliability. In addition, since the adhesive agent 48" and the defining region 35 do not overlap each other, variation in the amount of deformation of the vibration plate 31 due to variation in the position of the adhesive agent 48" can be prevented. Thus, even when adhesive agent having no photosensitivity as the adhesive agent 48", that is, adhesive agent likely to have variation in bonding position is used, variation in ink jetting characteristic can be prevented.

In the embodiments described above, the sealing plate 33 including the drive circuit 46 is described as the circuit board according to the invention, but the invention is not limited thereto. For example, the drive circuit may be provided to other member (such as drive IC) different from the sealing plate, and only wiring for relaying a signal from this drive circuit may be formed on the sealing plate 33. Thus, the circuit board in the invention includes not only the sealing plate including the drive circuit, but also a simple sealing plate on which only wiring is formed.

In the first, second, third, and fifth embodiments described above, both ends of the defining region 35 are covered by the adhesive agent 48, but the invention is not limited thereto. At least one end of the defining region needs to be covered by the adhesive agent. Similarly, an element end on at least one side of the piezoelectric element needs to be covered by the adhesive agent. In the embodiments described above, the lower electrode layer 37 and the upper electrode layer 39 are connected with the bump electrodes 42 corresponding thereto on the piezoelectric layer 38, but the invention is not limited thereto. The bump electrodes only need to be electrically connected with at least one of the lower electrode layer and the upper electrode layer on the piezoelectric layer. In the embodiments described above, the bump electrodes 42 are provided on the sealing plate 33, but the invention is not limited thereto. For example, the bump electrodes may be provided on the pressure chamber forming plate. In the manufacturing method described above, the adhesive agent 48 is applied on the single crystal silicon substrate including the pressure chamber-forming plate 29, but the invention is not limited thereto. For example, the adhesive agent may be applied on the single crystal silicon substrate including the sealing plate.

In the embodiments described above, an inkjet recording head that is mounted on an inkjet printer is described as an inkjet head, the invention is applicable to a device that jets liquid other than ink. For example, the inkjet head according to the invention is applicable to a color material jet head used for manufacturing a color filter such as a liquid crystal display, an electrode material jet head used for forming electrodes of such as an organic electro luminescence (EL) display and a field emission display (FED), a living organic material jet head used for manufacturing biochip (a biochemical element), and the like.

REFERENCE SIGNS LIST

1 printer, 3 recording head, 14 actuator unit, 15 passage unit, 16 head case, 17 housing space, 18 reservoir, 21 nozzle plate, 22 nozzle, 24 communicating plate, 25 common liquid chamber, 26 individual communicating path, 29 pressure chamber-forming plate, 30 pressure chamber, 31 vibration plate, 32 piezoelectric element, 33 sealing plate, 35 defining region, 37 lower electrode layer, 38 piezoelectric layer, 39 upper electrode layer, 40 metallic layer, 42 bump electrode, 43 inner resin, 44 conductive film, 46 drive circuit, 48 adhesive agent

CITATION LIST

Patent Literature

[PTL 1] JP-A-2002-292871

The invention claimed is:

1. An inkjet head comprising:

a pressure chamber-forming plate in which a plurality of pressure chambers each communicating with a nozzle are formed in a first direction;

a vibration plate that defines one surface of each pressure chamber and allows for deformation of a defining region thereof;

a piezoelectric element formed by stacking a first electrode layer, a piezoelectric layer, and a second electrode layer in a region corresponding to the pressure chamber in an order from a surface of the vibration plate, which is opposite to the pressure chamber;

a circuit board that is arranged at an interval from the vibration plate, with a plurality of bump electrodes interposed therebetween, and outputs a signal for driving the piezoelectric element; and an adhesive agent that bonds the pressure chamber-forming plate and the circuit board, the adhesive agent bonding to a drive circuit of the circuit board, wherein an element end on at least one side of the piezoelectric element is formed outside of the defining region and covered by the adhesive agent in a second direction orthogonal to the first direction.

2. The inkjet head according to claim 1, wherein the adhesive agent is formed to extend from the element end to a position overlapping an end of the defining region in the second direction, which is closer to the element end.

3. The inkjet head according to claim 1, wherein the bump electrode includes elastic resin, and a conductive film covering a surface of the resin.

4. The inkjet head according to claim 1, wherein the bump electrode is electrically connected with at least one of the first electrode layer and the second electrode layer on the piezoelectric layer formed in a region outside of the defining region.

5. The inkjet head according to claim 1, wherein the adhesive agent is photosensitive.

6. An inkjet printer comprising the inkjet head according to claim 1.

* * * * *